US012173707B2

(12) United States Patent
Holbrook et al.

(10) Patent No.: US 12,173,707 B2
(45) Date of Patent: Dec. 24, 2024

(54) ADJUSTABLE SCROLL PUMP

(71) Applicant: Edwards Limited, Burgess Hill (GB)

(72) Inventors: Alan Ernest Kinnaird Holbrook, Burgess Hill (GB); Nigel Paul Schofield, Burgess Hill (GB); David Bedwell, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 17/606,277

(22) PCT Filed: Apr. 24, 2020

(86) PCT No.: PCT/GB2020/051018
§ 371 (c)(1),
(2) Date: Oct. 25, 2021

(87) PCT Pub. No.: WO2020/217065
PCT Pub. Date: Oct. 29, 2020

(65) Prior Publication Data

US 2022/0299027 A1 Sep. 22, 2022

(30) Foreign Application Priority Data

Apr. 26, 2019 (GB) ..... 1905823

(51) Int. Cl.
*F04C 18/00* (2006.01)
*F01C 21/02* (2006.01)
(Continued)

(52) U.S. Cl.
CPC ..... *F04C 18/0215* (2013.01); *F01C 21/02* (2013.01); *F04C 27/001* (2013.01);
(Continued)

(58) Field of Classification Search
CPC ..... F04C 18/0215; F04C 18/0207; F04C 23/008; F04C 27/001; F04C 29/0057;
(Continued)

(56) References Cited

U.S. PATENT DOCUMENTS 4,178,143 A 12/1979 Thelen et al.
4,610,610 A * 9/1986 Blain ..... F04C 18/023 418/55.5
(Continued)

FOREIGN PATENT DOCUMENTS

CN 101100995 A 1/2008
CN 204163986 U 2/2015
(Continued)

OTHER PUBLICATIONS

WO2005/064165A1—Masuda et al.—Scroll compressor—Jul. 14, 2005—English Machine Translation. (Year: 2005).*
(Continued)

*Primary Examiner* — Theresa Trieu
(74) *Attorney, Agent, or Firm* — Theodore M. Magee; Westman, Champlin & Koehler, P.A.

(57) ABSTRACT

The Invention provides a scroll pump comprising an orbiting scroll and a fixed scroll, wherein the orbital axis of the orbiting scroll is movable in a radial direction relative to the fixed scroll while the orbiting scroll is orbiting about its orbital axis, or wherein the fixed scroll is movable relative to the orbiting scroll in a radial direction while the orbiting scroll is orbiting about its orbital axis.

13 Claims, 2 Drawing Sheets

(51) Int. Cl.

| | |
|---|---|
| ***F04C 18/02*** | (2006.01) |
| ***F04C 27/00*** | (2006.01) |
| ***F04C 29/00*** | (2006.01) |
| *F04C 23/00* | (2006.01) |

(52) U.S. Cl.
CPC ..... *F04C 29/0057* (2013.01); *F04C 23/008* (2013.01); *F04C 2230/603* (2013.01); *F04C 2240/56* (2013.01)

(58) Field of Classification Search
CPC ..... F04C 2230/603; F04C 2240/56; F01C 21/02; F16C 27/066; F16C 35/077; F16C 2360/43
See application file for complete search history.

(56) References Cited

U.S. PATENT DOCUMENTS

| | | | | |
|---|---|---|---|---|
| 4,753,582 | A * | 6/1988 | Morishita | F04C 18/023 418/60 |
| 4,846,639 | A * | 7/1989 | Morishita | F04C 18/023 418/55.5 |
| 5,713,731 | A | 2/1998 | Utter et al. | |
| 6,267,572 | B1 | 7/2001 | Suefuji et al. | |
| 2014/0161649 | A1 | 6/2014 | Hayashi | |
| 2015/0152866 | A1 | 6/2015 | Forni | |
| 2015/0159650 | A1* | 6/2015 | Forni | F04C 18/0215 418/55.1 |

FOREIGN PATENT DOCUMENTS

| | | | |
|---|---|---|---|
| CN | 108026927 | A | 5/2018 |
| EP | 2096311 | A1 | 9/2009 |
| GB | 1593446 | A | 7/1981 |
| JP | S62210279 | A | 9/1987 |
| WO | 2005064165 | A1 | 7/2005 |

OTHER PUBLICATIONS

British Examination Report dated Oct. 21, 2019 and Search Report dated Oct. 18, 2019 for corresponding British Application No. GB1905823.9, 7 pages.

PCT Notification of Transmittal of the International Search Report and the Written Opinion of the International Searching Authority, or the Declaration dated Aug. 4, 2020 and PCT Search Report dated Aug. 4, 2020 for corresponding PCT Application No. PCT/GB2020/051018.

PCT Written Opinion dated Aug. 4, 2020 for corresponding PCT Application No. PCT/GB2020/051018.

Japanese Notification of Reason for Rejection dated Feb. 28, 2024 for corresponding Japanese Application No. JP2021-562880, 3 pages.

Chinese Search Report dated Feb. 20, 2024 for corresponding Chinese Application No. CN202080031633.2, 3 pages.

* cited by examiner

ADJUSTABLE SCROLL PUMP

CROSS-REFERENCE OF RELATED APPLICATION

This application is a Section 371 National Stage Application of International Application No. PCT/GB2020/051018, filed Apr. 24, 2020, and published as WO 2020/217065 A1 on Oct. 29, 2020, the content of which is hereby incorporated by reference in its entirety and which claims priority of British Application No. 1905823.9, filed Apr. 26, 2019.

FIELD

The present invention relates to scroll pumps, in particular vacuum scroll pumps.

BACKGROUND

Known scroll compressors, or pumps, comprise a fixed scroll, an orbiting scroll and a drive mechanism for the orbiting scroll. The drive mechanism is configured to cause the orbiting scroll to orbit relative to the fixed scroll to cause pumping of a fluid between a pump inlet and a pump outlet. The fixed and orbiting scrolls each comprise an upstanding scroll wall extending from a generally circular base plate. Each scroll wall has an end, or tip, face disposed remote from and extending generally perpendicular to the respective base plate. The orbiting scroll wall is configured to mesh with the fixed scroll wall during orbiting of the orbiting scroll so that the relative orbital motion of the scrolls causes successive volumes of gas to be enclosed in pockets defined between the scroll walls and pumped from the inlet to the outlet.

To widen their usage there is an ongoing need for miniaturising of scroll pumps. However, it has been found by the inventors that as the capacity of scroll pumps are reduced, internal leakage becomes an increasing issue. This leakage impacts negatively on the ultimate pressure achievable by the pump. Indeed, below a certain pump capacity it may be impossible to have a minimum clearance between the scrolls that will not seize and to also have an average or maximum radial clearance that delivers acceptable performance.

The invention addresses, at least to an extent, these and other issues with known scroll pumps.

The discussion above is merely provided for general background information and is not intended to be used as an aid in determining the scope of the claimed subject matter. The claimed subject matter is not limited to implementations that solve any or all disadvantages noted in the background.

SUMMARY

Accordingly, in a first aspect the invention provides a scroll pump comprising an orbiting scroll and a fixed scroll. The orbiting scroll has an orbital axis. The orbital axis of the orbiting scroll may be movable in a radial direction relative to the fixed scroll while the orbiting scroll is orbiting about its orbital axis. Additionally, or alternatively, the fixed scroll may be movable relative to the orbiting scroll in a radial direction while the orbiting scroll is orbiting about its orbital axis. Preferably, the orbiting scroll is moved relative to the fixed scroll by pivoting or translating the drive shaft while the orbiting scroll is orbiting about its orbital axis.

This adjustable scroll pump may enable the orbiting scroll to be placed in its optimum radial location. This permits a radial clearance between the scrolls that is near constant in all crank orientations. The optimised positioning of the orbiting scroll permits a smaller radial clearance to be used, which leads to improved performance, including ultimate pressure and power.

Preferably, the scroll pump further comprises a first bearing coupled to a drive shaft for driving the orbital scroll. Preferably, first bearing is movable with the drive shaft in a direction substantially perpendicular to a rotational axis of the drive shaft.

Typically, the first bearing is coupled to a housing element of the scroll pump, the housing element being movable relative to the fixed scroll while the drive shaft is rotating. Preferably, the housing element is movable in a plane transverse to the axis of rotation of the scroll pump drive shaft. Preferably, the movable housing element may have its position relative to the fixed scroll fixed. The position at which housing element is fixed may be selected by the user.

Additionally, or alternatively, the scroll pump comprises a second bearing, the second bearing being coupled to the drive shaft and to a bearing carrier which is flexible in an axial direction. Preferably, in use, the flexible bearing carrier substantially eliminates movement of the rotor shaft in a radial direction.

Typically, the first bearing is coupled to the drive shaft such that the fixed scroll is positioned between the first bearing and the orbiting scroll. Typically, the first bearing is located at, or substantially at, an end of the drive shaft.

In a further aspect the invention provides a scroll chamber for a scroll pump having a capacity of less than 5 $m^3/h$, the scroll chamber containing an orbiting scroll and a fixed scroll each comprising an axially extending scroll wall, wherein the minimum radial clearance between the axially extending scroll wall of the orbiting scroll and the axially extending scroll wall of the fixed scroll whilst the orbiting scroll is orbiting is less than about 0.060 mm.

Such a clearance was not achievable with known scroll pumps of said capacity.

In a still further aspect, the invention provides an orbiting scroll and fixed scroll of a scroll pump, the orbiting scroll having an orbital axis and the fixed scroll having a longitudinal axis, wherein said orbital axis and longitudinal axis are coaxially aligned with a variation of less than about ±0.030 mm, preferably less than about ±0.010 mm.

In a still further aspect the invention provides, a method for centring an orbiting scroll and fixed scroll of a scroll pump, the scroll pump comprising an orbiting scroll and a fixed scroll which maintain a radial separation during pumping, the orbiting scroll being coupled to a drive shaft via an eccentric member, the drive shaft having an axis of rotation.

The method comprises, in a first step, rotating the eccentric member about the axis of rotation of the drive shaft to impart an orbiting action upon the orbiting scroll. Then, while the orbiting scroll is orbiting, moving the orbital axis of the orbiting scroll or longitudinal axis of the fixed scroll relative to the other in a first direction substantially perpendicular to the axis of rotation of the drive shaft until the orbiting scroll engages the fixed scroll. Upon said engagement whichever has moved of the orbital axis of the orbiting scroll or the longitudinal axis of the fixed scroll is in a first engagement position.

The method further includes the step of moving whichever has moved of the orbital axis of the orbiting scroll or longitudinal axis of the fixed scroll relative to the other in a second direction substantially opposite the first direction until the orbiting scroll again engages the fixed scroll. Upon said engagement whichever has moved of the orbital axis of the orbiting scroll or the longitudinal axis of the fixed scroll is in a second engagement position.

The method further includes positioning whichever has moved of the orbital axis of the orbiting scroll or the longitudinal axis of the fixed scroll in a first centred position substantially halfway between the first engagement position and the second engagement position and substantially in a first plane containing the first engagement position, second engagement position and the first centred position of whichever has moved of the orbital axis of the orbiting scroll or the longitudinal axis of the fixed scroll.

The method may further comprise the subsequent steps of rotating the eccentric member about the axis of rotation of the drive shaft to impart an orbiting action upon the orbiting scroll. Then, while the orbiting scroll is orbiting moving the orbital axis of the orbiting scroll or the longitudinal axis of the fixed scroll relative to the other in a third direction substantially perpendicular to the axis of rotation of the crank and different to, preferably substantially perpendicular to, the first and second directions until the orbiting scroll engages the fixed scroll. Upon said engagement whichever has moved of the orbital axis of the orbiting scroll or the longitudinal axis of the fixed scroll may be considered to be in a third engagement position.

The method may further include the steps of moving whichever has moved of the orbital axis of the orbiting scroll or the longitudinal axis of the fixed scroll relative to the other in a fourth direction substantially opposite the third direction until the orbiting scroll engages the fixed scroll. Upon said engagement whichever has moved of the orbital axis of the orbiting scroll or the longitudinal axis of the fixed scroll may be considered to be in a fourth engagement position.

The method may then include the step of positioning whichever has moved of the orbital axis of the orbiting scroll or the longitudinal axis of the fixed scroll in a second centred position substantially halfway between the third engagement position and the fourth engagement position substantially in a second plane containing the third engagement position, fourth engagement position and the second centred position of whichever has moved of the orbital axis of the orbiting scroll or the longitudinal axis of the fixed scroll.

Preferably, the second centred position is additionally substantially halfway between the first engagement position and the second engagement position substantially in a third plane containing the first engagement position, second engagement position and the second centred position of whichever has moved of the orbital axis of the orbiting scroll or the longitudinal axis of the fixed scroll.

In instances where the longitudinal axis of the fixed scroll is moved relative to the orbital axis of the orbiting scroll, the engagement positions and centred positions may be determined using a fixed point on the fixed scroll. Whereas, in instances where the orbital axis of the orbiting scroll is moved relative to the longitudinal axis of the fixed scroll the engagement positions and centred positions may be measured using a fixed point on the drive shaft. The planes (first, second and third) may be transverse to the axis of rotation of the drive shaft.

Preferably, the orbiting scroll is moved relative to the fixed scroll. Preferably, the orbiting scroll is moved relative to the fixed scroll by pivoting or translating the drive shaft.

Additionally, or alternatively, engagement between the fixed scroll and the orbiting scroll is detected by monitoring for the drive shaft ceasing to rotate.

Preferably, the drive shaft is rotated at a low speed, preferably less than about 5 Hz. Preferably, the drive shaft is rotated in a direction opposite to its pumping direction.

Typically, the drive shaft is rotated by directing an airflow through the scroll pump, preferably wherein the airflow is introduced via an exhaust duct of the scroll pump.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

In the following disclosure, which is given by way of example only, reference will be made to the drawings, in which.

DETAILED DESCRIPTION

The present invention provides a scroll pump, preferably a vacuum scroll pump, as well as methods for centring an orbiting scroll and a fixed scroll of a scroll pump.

Figure 1:
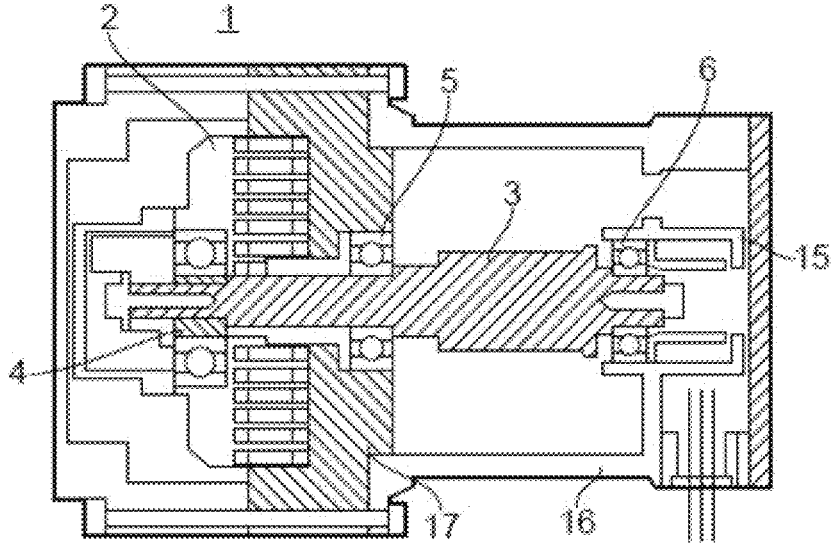
FIG. 1(Prior Art)
FIG. 1 is a schematic representation of a prior art scroll pump.

FIG. 1 shows a typical small capacity scroll pump (1). The orbiting scroll (2) is mounted on a rotating crank or drive shaft (3). The crank offset is provided by a sleeve (4). The central and rear crank bearings (5, 6) are held in fixed positions. In the illustrated example, the rear bearing (6) is held by a fixed bearing housing (15) integrally formed with the scroll pump housing (16). In the illustrated example, the radial clearance between the two scrolls (2, 17) is determined by nine components. The inventors have found that the combination of the manufacturing tolerances on these parts may create a total variation of approximately +/−0.2 mm.

As the capacity of vacuum pumps is reduced, internal leakage becomes an increasing issue for pump performance. This leakage impacts negatively on the ultimate pressure. In the illustrated configuration, it may be impossible to have a minimum clearance that will not seize and to also have an average or maximum radial clearance that delivers acceptable performance in a small capacity pump. For instance, a pump with a capacity below 5 $m^3/h$.

Figure 2:
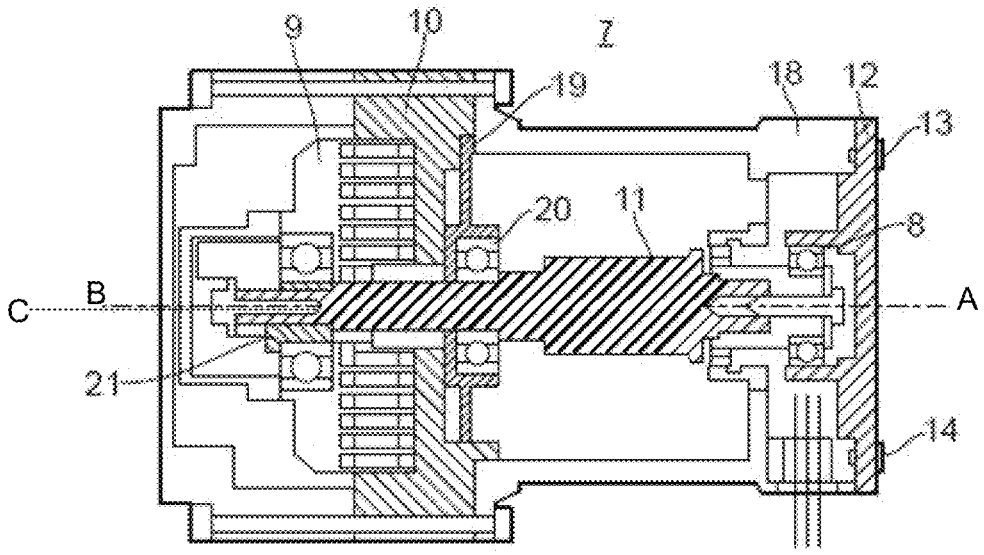
FIG. 2 is a schematic representation of a scroll pump according to the invention.

FIG. 2 shows a scroll pump (7) according to the invention. The illustrated scroll pump (7) has a rear shaft bearing (8) which is moveable to enable the radial position of the orbiting scroll (9) to be changed. This adjustment enables the orbiting scroll (9) to be placed in a substantially optimum radial location to deliver a radial clearance between the scrolls (9, 10) that is near constant in all crank (11) orientations. The optimised positioning of the orbiting scroll (9) permits a smaller radial clearance to be realised than is otherwise achievable, which in turn leads to improved performance, including lower ultimate pressure and power. The invention thereby facilitates the provision of smaller capacity scroll pumps. However, the skilled person will appreciate that the method and pump configuration may be successfully used in pumps of all sizes.

Figure 3:
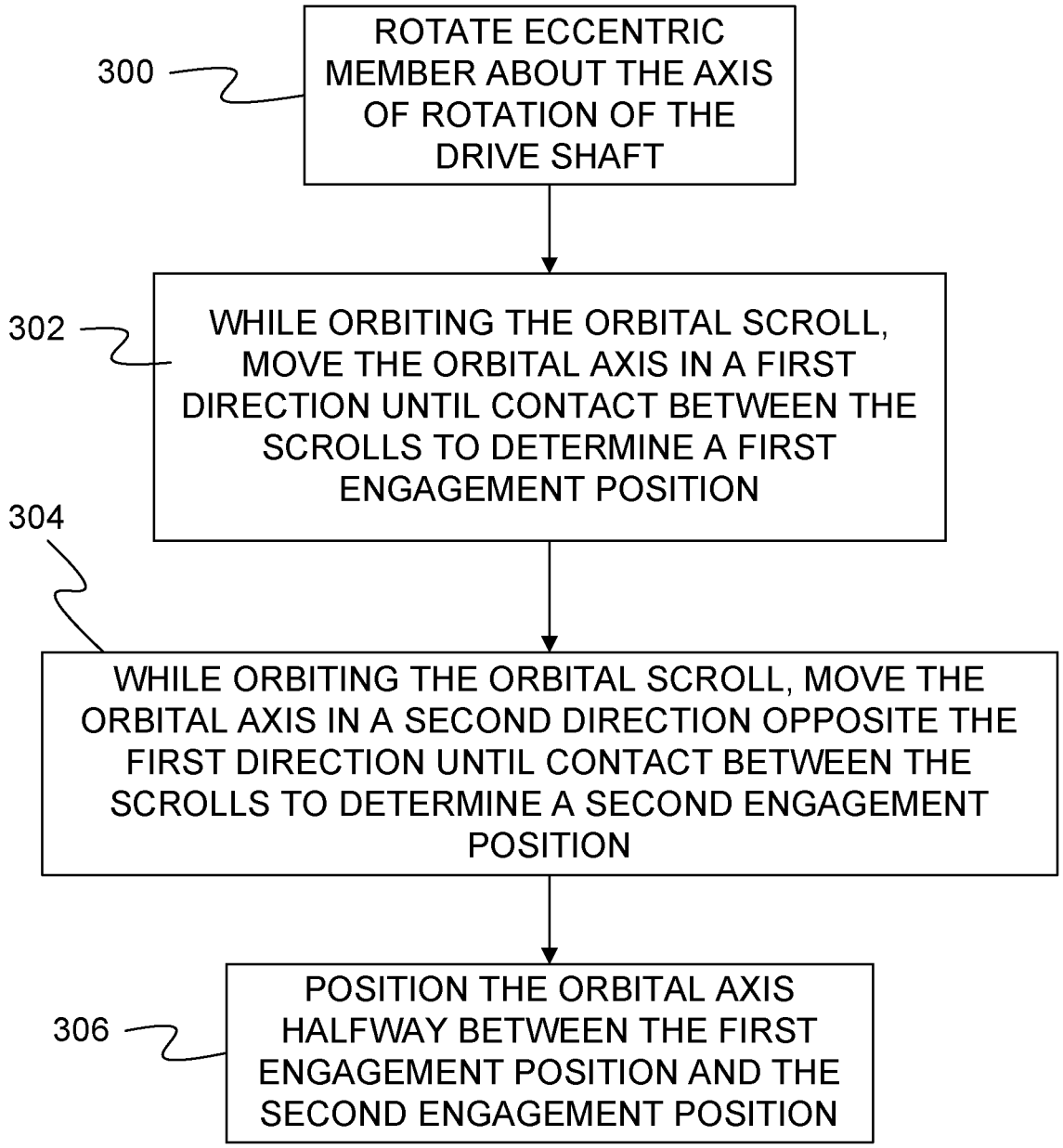
FIG. 3 is a flow diagram of a method of centring an orbiting scroll relative to a fixed scroll.

In the illustrated scroll pump (7), the rear bearing (8) is mounted in a slidable carrier (12) forming part of the scroll pump (7) housing (18). The carrier (12) is mounted on the motor body (28) and has drive screws (not shown) for moving the bearing housing (8) in 'X' and 'Y' directions. As shown in the flow diagram of FIG. 3, the pump (7) is run at low speed in reverse by applying 350 mbar of air to the pump's exhaust (not shown) to rotate an eccentric member 21 about the drive shaft (11) at step 300. At step 302, the orbiting axis B of orbiting scroll (9) is moved relative to the longitudinal axis C of fixed scroll (10) in a first direction perpendicular to the axis of rotation A of the drive shaft while the orbiting scroll is orbiting. The pump's rotation stops when the scrolls (9, 10) contact each other marking a first engagement position. At step 304, the orbiting axis of orbiting scroll (9) is moved relative to the longitudinal axis C of fixed scroll (10) in a second direction opposite the first direction while the orbiting scroll is orbiting. The pump's rotation stops when the scrolls (9, 10) contact each other marking a second engagement position. In this way, the extreme positions at which the pump (7) will run can be found. At step 306, the orbital axis B of the orbiting scroll is set to a substantially central position between the first engagement position and the second engagement position by moving rear bearing (8). This may be done in both 'X' and 'Y' directions. Then the rear bearing's position is locked, e.g. by tightening the screws (13, 14) on the bearing carrier (12). The relatively low air pressure applied to the exhaust ensures that only a light contact is required to stop rotation, avoiding damage to the scrolls (9, 10). The illustrated bearings (8, 20) are ball bearings.

In an alternative arrangement the pump motor may be run in a forward or a reverse direction at a low speed (e.g. less than about 5 Hz) and contact may be determined using a torque meter; the pump motor being cut when the torque meter determines an increase in torque attributable the scrolls contacting.

In the embodiment shown in FIG. 2, the central bearing (20) is held in a flexible bearing carrier (19). The flexible bearing carrier (19) may flex in an axial direction but, in use, substantially eliminates radial movement of the drive shaft (11). The flexible bearing carrier (19) combined with the adjustable rear bearing (8) may deliver a high degree of control over the position of the orbiting scroll (9) relative to the fixed scroll (10). Typically, the flexible bearing carrier is metallic, typically the flexible bearing carrier is made from an aluminium alloy or steel. Typically, in use, the flexible bearing carrier enables the bearing to move from about −0.5 to about ±0.5 mm in an axial direction.

Unless stated otherwise, for the purpose of the invention, axial and longitudinal directions relate to a direction substantially parallel to the axis of rotation (A) of the drive shaft (11) of the pump. Radially refers to a direction extending out from the axis of rotation (A) of the drive shaft (11) transverse to the longitudinal direction.

In alternative arrangements, the position of the rear bearing may be fixed and the middle (or central) bearing may be movable. Both arrangements enable the movement of the orbital axis of the orbiting scroll relative to the fixed scroll. In still further alternative arrangements, the fixed scroll may be movable relative to the orbital axis of the orbiting scroll. Orbiting scroll is a term of art and refers to the scroll that orbits during use of the scroll. It will be appreciated that the orbiting scroll may itself be stationary when the pump is not in use.

It shall be appreciated that various modifications may be made to the embodiments shown without departing from the spirit and scope of the invention as defined by the accompanying claims as interpreted under patent law.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A scroll pump comprising an orbiting scroll and a fixed scroll, wherein an orbital axis of the orbiting scroll is movable in a radial direction relative to the fixed scroll while the orbiting scroll is orbiting about the orbital axis, and wherein the scroll pump further comprises a first bearing coupled to a drive shaft for driving the orbiting scroll, wherein the first bearing is movable with the drive shaft in a direction perpendicular to a rotational axis of the drive shaft and the first bearing is coupled to a housing element of the scroll pump, the housing element being movable relative to the fixed scroll while the drive shaft is rotating.

2. The scroll pump according to claim 1 wherein the movable housing element has its position relative to the fixed scroll selectively fixed.

3. The scroll pump according to claim 1 further comprising a second bearing, the second bearing being coupled to the drive shaft and to a bearing carrier which is flexible in an axial direction.

4. The scroll pump according to claim 1 wherein the first bearing is located in a position from a distal end of the drive shaft to adjacent the fixed scroll.

5. A method for centring an orbiting scroll and a fixed scroll of a scroll pump, the orbiting scroll and the fixed scroll maintaining a radial separation during pumping, the orbiting scroll being coupled to a drive shaft via an eccentric member, and the drive shaft having an axis of rotation, the method comprising the steps of:

a. rotating the eccentric member about the axis of rotation of the drive shaft to impart an orbiting action upon the orbiting scroll;

b. while the orbiting scroll is orbiting moving the orbital axis of the orbiting scroll relative to the longitudinal axis of the fixed scroll in a first direction perpendicular to the axis of rotation of the drive shaft until the orbiting scroll engages the fixed scroll, upon said engagement the orbital axis of the orbiting scroll being in a first engagement position, c. moving the orbital axis of the orbiting scroll relative to the longitudinal axis of the fixed scroll in a second direction opposite the first direction until the orbiting scroll again engages the fixed scroll, upon said engagement the orbital axis of the orbiting scroll being in a second engagement position, and d. positioning the orbital axis of the orbiting in a first centred position halfway between the first engagement position and the second engagement position and in a first plane containing the first engagement position, second engagement position and the first centred position of the orbital axis of the orbiting scroll.

6. The method according to claim 5 further comprising the subsequent steps of:

e. rotating the eccentric member about the axis of rotation of the drive shaft to impart an orbiting action upon the orbiting scroll;

f. while the orbiting scroll is orbiting moving the orbital axis of the orbiting scroll relative to the longitudinal axis of the fixed scroll in a third direction perpendicular to the axis of rotation of the drive shaft and perpendicular to the first direction until the orbiting scroll engages the fixed scroll, upon said engagement the orbital axis of the orbiting scroll being in a third engagement position, g. moving the orbital axis of the orbiting scroll relative to the longitudinal axis of the fixed scroll in a fourth direction opposite the third direction until the orbiting scroll engages the fixed scroll, upon said engagement the orbital axis of the orbiting scroll being in a fourth engagement position, and h. positioning the orbital axis of the orbiting scroll in a second centred position halfway between the third engagement position and the fourth engagement position in a second plane containing the third engagement position, fourth engagement position and the second centred position of the orbital axis of the orbiting scroll.

7. The method according to claim 6 wherein second centred position is additionally halfway between the first engagement position and the second engagement position in a third plane containing the first engagement position, second engagement position and the second centred position of the orbital axis of the orbiting scroll.

8. The method according to claim 5 wherein the engagement between the fixed scroll and the orbiting scroll is detected by monitoring for the drive shaft ceasing to rotate.

9. The method according to claim 5 wherein the drive shaft is rotated at a low speed, less than 5 Hz.

10. The method according to claim 5 wherein the drive shaft is rotated by directing an airflow through the scroll pump.

11. The method according to claim 5 wherein the drive shaft is rotated in a direction opposite to its pumping direction.

12. The method according to claim 5 wherein the orbiting scroll is moved relative to the fixed scroll by pivoting or translating the drive shaft.

13. The method of claim 5 wherein the scroll pump further comprises a first bearing coupled to the drive shaft, wherein the first bearing is movable with the drive shaft in a direction perpendicular to a rotational axis of the drive shaft.

* * * * *